United States Patent [19]

Shoup

[11] 4,023,009

[45] May 10, 1977

[54] VOTING MACHINE WITH PRIMARY ELECTION SELECTION

[76] Inventor: Ransom F. Shoup, 400 Morris Ave., P.O. Box 389, Bryn Mawr, Pa. 19010

[22] Filed: Aug. 5, 1975

[21] Appl. No.: 602,096

Related U.S. Application Data

[62] Division of Ser. No. 438,476, Jan. 31, 1974, Pat. No. 3,915,374.

[52] U.S. Cl. ..... 235/55 C

[51] Int. Cl.[2] ..... G07C 13/00

[58] Field of Search ..... 235/54 A, 54 B, 54 C, 235/54 D, 55 R, 55 A, 55 C

[56] References Cited

UNITED STATES PATENTS 750,987 2/1904 Loe ..... 235/54 C 3,408,002 10/1968 Martin ..... 235/54 D

*Primary Examiner*—E. S. Jackmon

*Attorney, Agent, or Firm*—Woodcock Washburn Kurtz & Mackiewicz

[57] ABSTRACT

A mechanical voting machine can be easily adapted to operate in a selective primary. The selective primary mechanism includes at least two party selector spindles each having a bell crank with a lug which engages an associated ladder channel at the top and bottom of a small opening therein. Columns of voting spindles are interconnected in groups so that the ladder channels of each group are moved up and down in unison. Pull straps connect each group of columns to a primary election interlock so that movement of one of the straps in a direction corresponding with an unlocking movement of a group of ladder channels immobilizes the other straps in the primary election interlock.

2 Claims, 6 Drawing Figures

VOTING MACHINE WITH PRIMARY ELECTION SELECTION

This application is a divisional application of Ser. No. 438,476, filed Jan. 31, 1974 which is now U.S. Pat. No. 3,915,374.

BACKGROUND OF THE INVENTION

This invention relates to voting machines and more particularly to a voting machine with a primary election mechanism.

A mechanical voting machine is shown in the Shoup U.S. Pat. No. 2,054,102. Mechanical voting machines of this type employ interlocks to limit the number of votes which may be cast for a candidate. Interlocks are shown, for example, in the Shoup U.S. Pat. No. 2,293,669. U.S. Pat. No. 3,054,557 Shoup et al describes a voting machine which can be used in either a declared or a selective primary.

In a declared primary election the voter must give the name of this party and the election officer adjusts the machine so as to lock out the voting facilities of all parties other than that to which the voter belongs. Shoup et al U.S. Pat. No. 3,051,379 is an example of a voting machine capable of operation in a declared primary.

In a selective primary the voter does not give the name of this party, but the machine is so arranged that, if the voter turns the voting spindles assigned to a candidate running for the office of mayor of the ticket of one party, the voting spindles assigned to other candidates running for the same office on the ticket of other parties, are locked out. Alternatively, the voter turns a party selector knob which allows him to vote for the candidates of his party, but the candidates of all other parties are locked out.

SUMMARY OF THE INVENTION

In accordance with this invention a voting machine is easily adapted for use in a selective primary or a declared primary.

It is a further object of this invention to provide an improved selective primary mechanism which is easily installed, and is reliable in operation.

DESCRIPTION OF A PREFERRED EMBODIMENT

Figure 1:
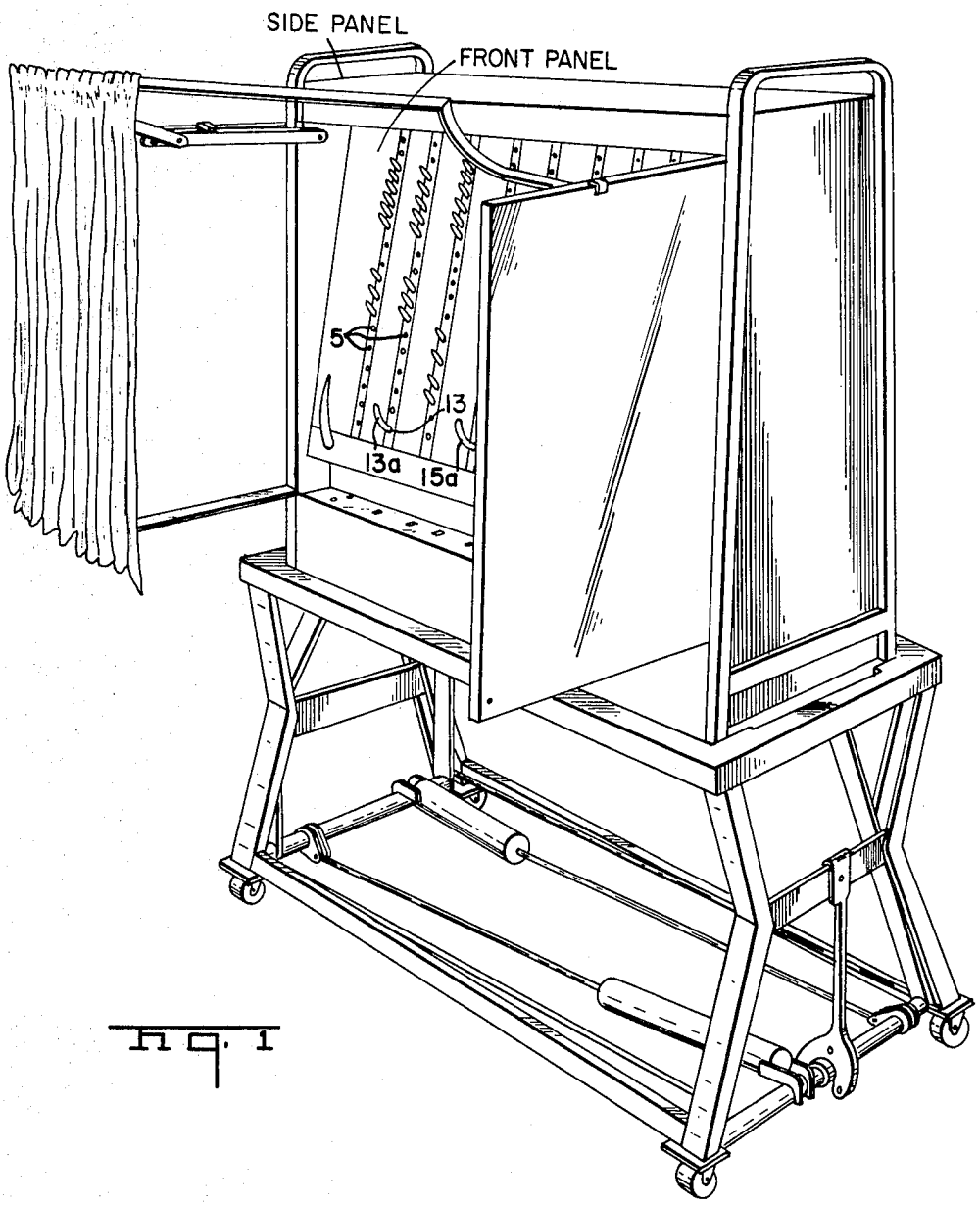
FIG. 1 is a perspective view of a voting machine.

FIG. 1 shows a voting machine with the usual columns of voting levers which a voter rotates to select the candidate of this choice. These levers rotate voting spindles 5. In a selective primary rotation of a voting lever in a group associated with a particular party will lock out the candidates of all other parties on the machine. Levers 13 and 15 for two party selector spindles are shown. (The spindles are also designated 13 and 15.) Rotation of the party selector spindle 13 actuates an interlock mechanism which permits voting for the candidates of that party but locks out all candidates of other parties. Alternatively, rotation of the party selector spindles 13 or 15 can clear choices previously made and permits voting for the candidates of a party other than the choice originally made.

Figure 2:
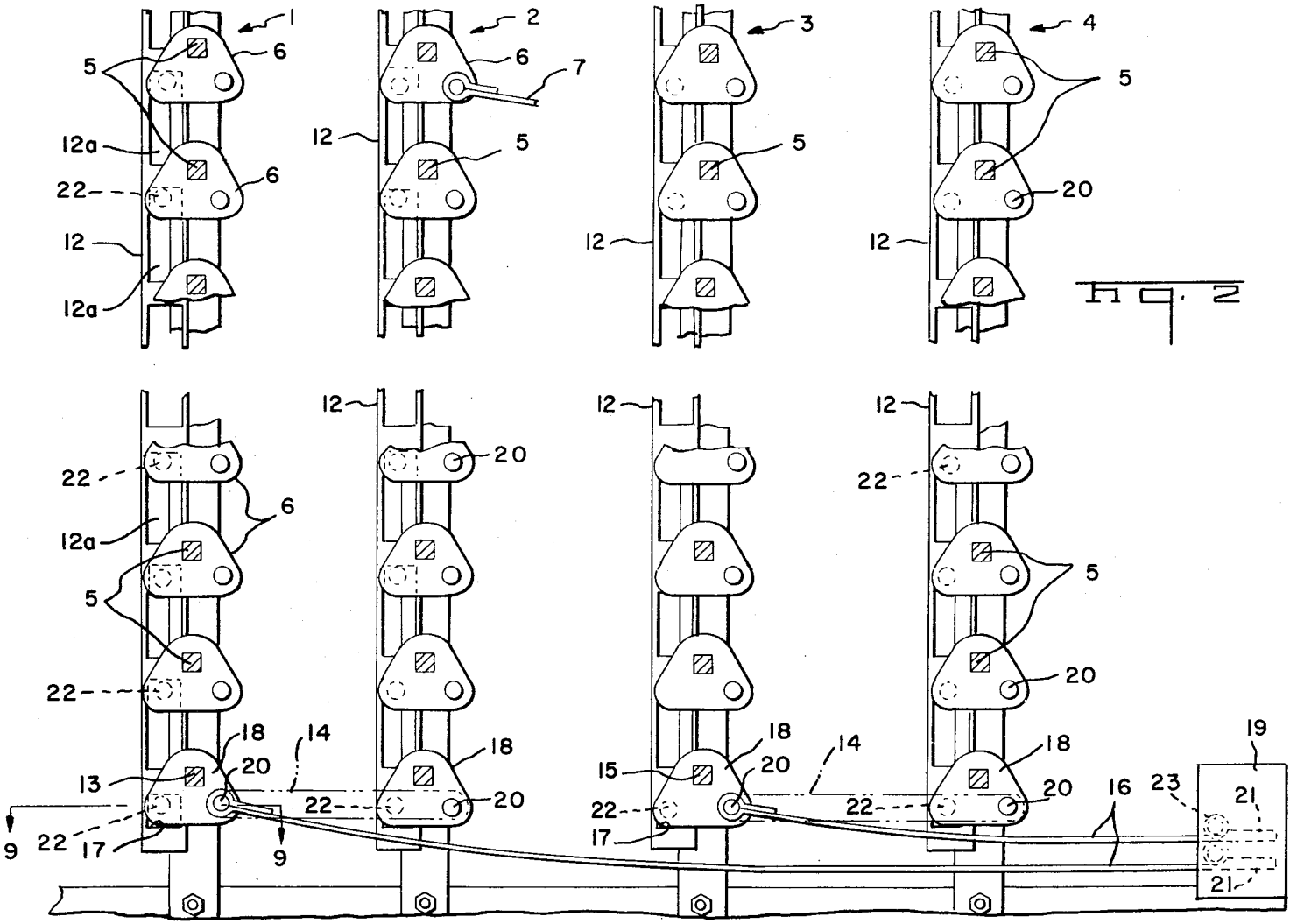
FIG. 2 shows columns of voting spindles, associated bell cranks, and a primary election interlock for a selective primary.
Figure 3:
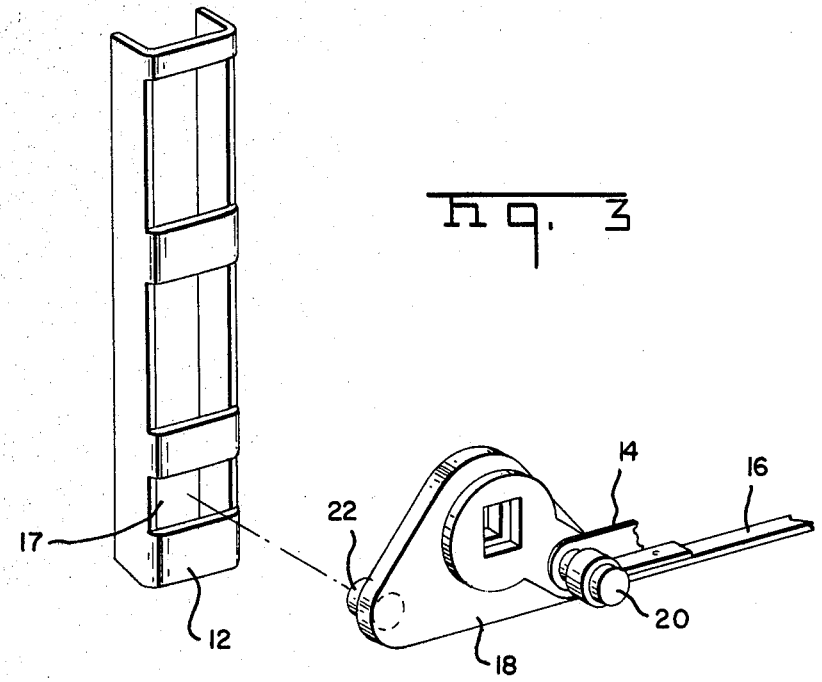
FIG. 3 shows a ladder channel and associated bell crank.

FIG. 2 shows four columns 1–4 of voting machine spindles. The spindles 5 in column 1 and in column 2 are associated with levers for the selection of the candidates of one party, for example, the Republican party. The spindles 5 in the columns 3 and 4 are associated with voting levers of another party, for example, the Democratic party. The usual bell cranks, or butterfly assemblies 6, are mounted on each of the spindles 5. Pull straps such as 7 engage a vertical voting interlock, or, under certain ballot adaptations, they engage a general election interlock. These interlocks are not shown but are similar in construction to the interlock 19 shown in FIG. 4. The structure of the pull straps and the interlock is such that movement of any of the straps in vote casting direction immobilizes other straps for that office.

A ladder channel 12 has a plurality of vertically spaced openings or cutout portion 12A. The ladder channels are each guided for movement in a vertical direction by a ladder retainer. A lug 22 on each butterfly engages the ladder channel at the top of one of the openings therein. When the ladder channel is moved upwardly, any one of the voting spindles in that column can be rotated in a vote casting direction. However, when the ladder 12 is in a lower vertical position, the lug 22 on each butterfly assembly firmly engages the top of the opening in the ladder channel and rotation in a vote casting direction is prevented.

Party selector spindles 13 and 15 each have a bell crank 18 with a lug 22 thereon. The lug 22 on the bell crank 18 engages a small hole 17 in the bottom of the ladder channel. If the selector spindle 13 is rotated by the voter, the ladder channel 12 is raised. Then all of the voting spindles in that column are free of engagement with the ladder channel and may be rotated. Alternatively, if the voter first rotates one of the voting spindles, then the ladder channel 12 is raised and voting spindles in that column are similarly free. If the voter changes his mind about voting for that party, rotation of the selector spindle in the counterclockwise direction will return the ladder channel 12 to its lower position. Then the voter may proceed to vote for the candidate of another party.

A bar 14 interconnects the spindles in the columns 1 and 2, the Republican group of columns. Similarly, the bar interconnects columns 3 and 4 of voting spindles in the Democratic group. (While two columns of spindles have been shown in the Republican group and two columns of spindles in the Democratic, it will be appreciated that more columns could be interconnected in each group and more groups can be provided for other parties.)

The bars 14 interconnect the voting spindles in groups so that the ladder channels of each group are moved up and down in unison. That is, when the ladder channel 12 in column 1 is moved upwardly to free voting spindles for rotation in that column, the ladder channel 12 in column 2 is similarly moved upwardly to free voting spindles in that column for movement in vote casting direction.

Figure 4:
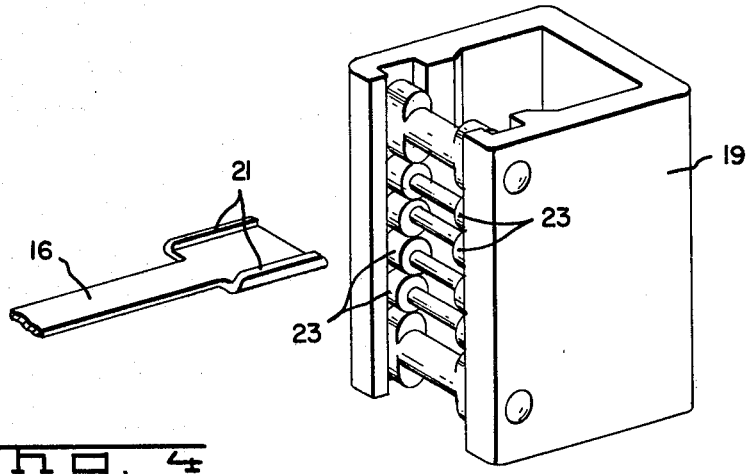
FIG. 4 shows an interlock and a pull strap.
Figure 5:
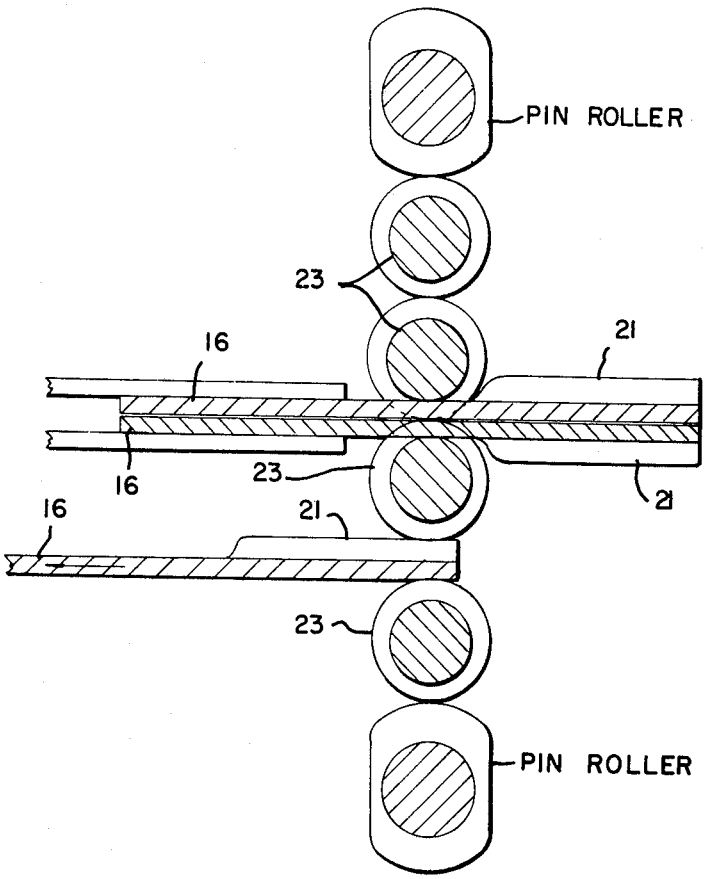
FIGS. 5 and 6 show details of an interlock.
Figure 6:
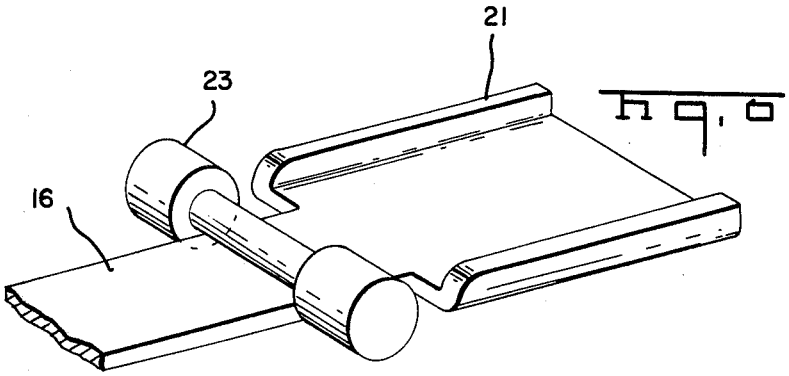

A primary election interlock 19 is shown in more detail in FIG. 4. This insures that the voter can cast his vote only for candidates of one party. A pull strap 16 is connected to the pin 20 on the butterfly assembly 18. A similar pull strap 16 is provided for each group of spindles, i.e., one for the Republican candidates, one for the Democratic candidates and one for each other political party on the ballot. Each of the pull straps 16 terminates in a wedged shaped portion 21 at the end thereof. The interlock 19 includes rollers 23 between, above and below the pull straps. (FIGS. 2 and 4) These rollers are arranged so that only one pull strap can be pulled to the left. Movement of one of the straps in a direction to the left corresponding with an unlocking movement of a group of ladder channels immobilizes the other straps in the interlock 19. Therefore, when the ladder channels 12 in columns 1 and 2 (FIG. 2) are moved upwardly in a direction which unlocks the voting spindles in that group, then the ladder channels in columns 3 and 4 cannot be moved upwardly because the pull strap 16 associated with that group cannot be moved to the left out of the interlock 19. FIGS. 5 and 6 depict the wedge shaped ends 21 and the rollers 23 in more detail.

FIG. 7 is a top view showing the elements associated with one voting spindle. The strap 16 (FIG. 7) goes to a general election interlock which is not shown. The general election interlock controls the party candidates for which the voter can vote.

The butterfly 18 has a lug 22 which engages an opening in the ladder channel 12. A ladder retainer 10 guides the ladder channel for movement in the vertical direction. The operation of the ladder channel is as described with reference to FIG. 2.

While a particular embodiment of the invention has been shown and described, it will be appreciated that modifications are within the true spirit and scope of the invention. The appended claims are intended to cover such modifications.

What is claimed is:

1. In a voting machine of the type which includes columns of voting spindles, a main interlock, pull straps connected to said spindles and engaging said interlock, bell cranks having lugs thereon mounted for rotation on each of said voting spindles, and ladder channels having a plurality of vertically spaced openings, the lug on each bell crank engaging a ladder channel at the top of one of said openings, a selective primary mechanism comprising:

at least two party selector spindles each having a bell crank with a lug thereon, each lug engaging an associated ladder channel at the top and bottom of a small opening therein so that rotation of a party selector spindle to a nonvoting position acts through said ladder channels and bell cranks to clear said voting spindles of choices previously made but not voted, means interconnecting columns of voting spindles in groups os that the ladder channels of each group are moved up and down in unison so that rotation any voting spindle in a group moves the ladder channels of that group upwardly in unison to permit voting by rotation of any voting spindle in that group, a primary election interlock, and pull straps connecting each group of columns to said primary election interlock, so that movement of one of said straps in a direction corresponding with an unlocking movement of a group of ladder channels immobilizes the other straps in said interlock and ladder channels connected thereto.

2. The mechanism recited in claim 1 further comprising a ladder retainer for each ladder channel guiding each ladder channel for vertical movement.

* * * * *

UNITED STATES PATENT AND TRADEMARK OFFICE

CERTIFICATE OF CORRECTION

PATENT NO. : 4,023,009

DATED : May 10, 1977

INVENTOR(S) : Ransom F. Shoup

It is certified that error appears in the above-identified patent and that said Letters Patent are hereby corrected as shown below:

Column 1, line 22, delete "this" and insert --his--;

line 29, delete "this" and insert --his--; and line 59, delete "this" and insert --his--.

Column 2, line 50, after "bar" insert --14--.

Column 4, line 21, delete "os" and insert --so--.

Signed and Sealed this thirtieth Day of August 1977

[SEAL]

*Attest:*

RUTH C. MASON
*Attesting Officer*

C. MARSHALL DANN
*Commissioner of Patents and Trademarks*